US006025783A

United States Patent [19]

Steffens, Jr.

[11] Patent Number: 6,025,783

[45] Date of Patent: Feb. 15, 2000

[54] WIRELESS SWITCH DETECTION SYSTEM

[75] Inventor: Charles E. Steffens, Jr., Washington, Mich.

[73] Assignee: TRW Vehicle Safety Systems Inc., Lyndhurst, Ohio

[21] Appl. No.: 09/070,320

[22] Filed: Apr. 30, 1998

[51] Int. Cl.[7] ..... G08B 21/00

[52] U.S. Cl. ..... 340/644; 340/572.1; 340/572.5; 340/572.8; 340/825.54; 340/679; 340/687; 340/686.4; 200/61.58 B; 280/735; 180/262; 180/268

[58] Field of Search ..... 340/572.1, 572.5, 340/572.8, 644, 679, 687, 686.1, 686.4, 825.54; 361/113; 374/154; 200/61.58 B; 280/735; 180/268, 262

[56] References Cited

U.S. PATENT DOCUMENTS

| | | | |
|---|---|---|---|
| 3,338,100 | 8/1967 | Takami | 374/154 |
| 3,833,781 | 9/1974 | Rumpf | 200/61.58 B |
| 4,071,875 | 1/1978 | Kochem | 361/113 |
| 4,984,651 | 1/1991 | Grosch et al. | 180/268 |
| 5,023,408 | 6/1991 | Murakami et al. | 178/19 |
| 5,338,063 | 8/1994 | Takeuchi et al. | 280/735 |
| 5,347,262 | 9/1994 | Thurmond et al. | 340/572.9 |
| 5,541,574 | 7/1996 | Lowe et al. | 340/447 |
| 5,571,253 | 11/1996 | Blackburn et al. | 180/282 |
| 5,605,348 | 2/1997 | Blackburn et al. | 280/735 |
| 5,829,782 | 11/1998 | Breed et al. | 280/735 |

FOREIGN PATENT DOCUMENTS 9906244 11/1999 WIPO .

*Primary Examiner*—Benjamin C. Lee
*Attorney, Agent, or Firm*—Tarolli, Sundheim, Covell, Tummino & Szabo L.L.P.

[57] ABSTRACT

A wireless switch detection system (10, 100) includes central transmitter (22, 109) for transmitting a transmitter signal. The system (10, 110) also includes a remote switch (28, 128) spaced apart from the central transmitter (22, 109) and having at least two states. A tag circuit (32, 136) is responsive to and powered by the transmitter signal. The tag circuit (32, 136) detects the state of the remote switch (28, 128) and, in response to the transmitter signal, provides a tag signal indicative of the state of the switch (28, 128). A central receiver (26, 111) receives the tag signal.

22 Claims, 2 Drawing Sheets

WIRELESS SWITCH DETECTION SYSTEM

BACKGROUND OF THE INVENTION

The present invention relates to a switch detection system and more particularly to a system for detecting the state of a remote switch.

Switches commonly are used in connection with various equipment to provide information about the equipment. By knowing the state of the switch, such as open or closed, the condition of associated equipment may be monitored. For example, in an automobile, switches are used to detect whether a door is open or closed and whether a seat belt is buckled or unbuckled.

In a typical system, remote switch status information is monitored at a central station via one or more connecting wires. It is desirable, however, to reduce or eliminate the connecting wires and still monitor the state of the remote switch. This is particularly true in the above-identified example relating to vehicles, as additional wires needed to form a system to monitor numerous remote switches typically results in an increase in cost.

SUMMARY OF THE INVENTION

The present invention is directed to a wireless switch detection system that includes a central transmitter for transmitting a transmitter signal. A remote switch having at least two states is spaced apart from the central transmitter. The system also includes a tag circuit that is responsive to and powered by the transmitter signal. The tag circuit detects the state of the remote switch and, in response to the transmitter signal, transmits a tag signal to a central receiver according to the state of the switch.

BRIEF DESCRIPTION OF THE DRAWINGS

Preferred embodiments of the present invention are illustrated in the accompanying drawings in which.

DESCRIPTION OF PREFERRED EMBODIMENTS

Figure 1:
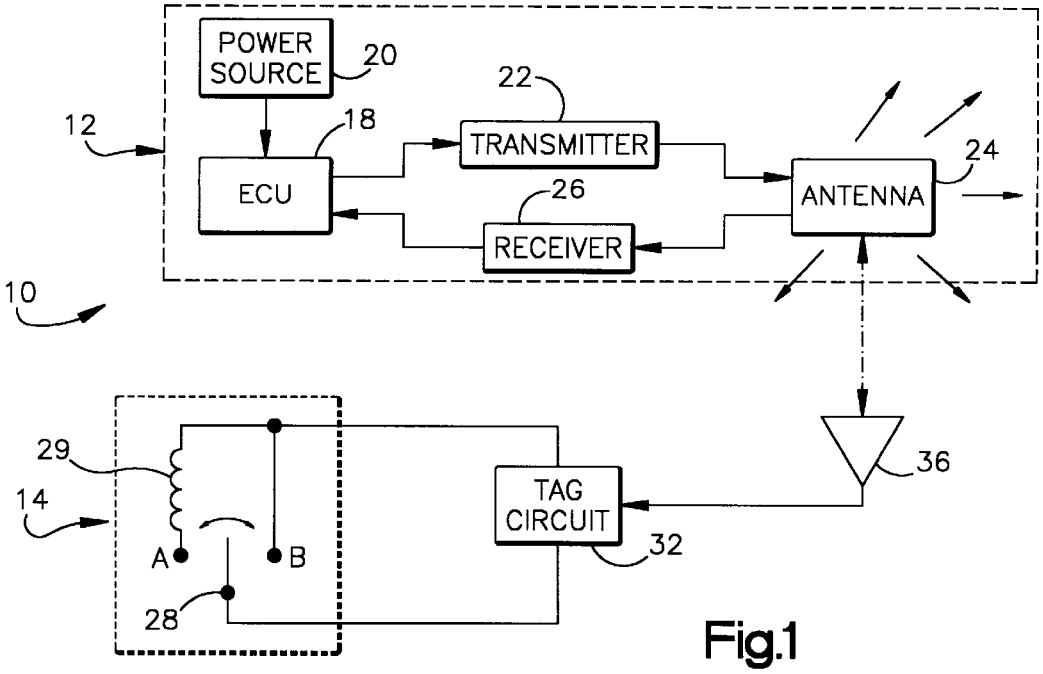
FIG. 1 is a schematic view of a system in accordance with the present invention.

FIG. 1 illustrates a preferred embodiment of a remote switch detection system, generally indicated as 10. The system 10 includes a central station, indicated as 12, and a remote site 14 separated and spaced apart from the central station 12. The central station 12 includes an electronic control unit (ECU) 18 electrically coupled to a power source 20, which may comprise an energy storage device, such as a battery, or another source of power. Preferably, the ECU 18 is a microcomputer, but may also comprise a plurality of discrete circuits, circuit components, and/or an application specific integrated circuit (ASIC) configured to accomplish desired functions.

The ECU 18 is coupled to a transmitter 22 for transmitting a transmitter signal throughout the system 10. The transmitter 22 is coupled to an antenna 24, which transmits the transmitter signal at a predetermined frequency in a plurality of directions. A central receiver 26 also is coupled to the antenna 24 and to the ECU 18 for receiving signals from the remote site 14. A physical connection, such as wiring, between the remote site 14 and the central station 12 is not required for operation of the present invention.

The system 10 also includes at least one remote switch 28 at the remote site 14 spaced apart from the central station antenna 24. The switch 28 has at least two states A and B that are indicative of preselected conditions. It will be appreciated that while, for simplicity of illustration, the switch 28 is shown to have two states A and B, such switch 28 may conveniently have more than two discrete states.

The remote site 14 also includes a tag circuit 32 physically separated from the central transmitter 22. The tag circuit 32 is responsive to and powered by the transmitter signal from the antenna 24 of the central station 12. The tag circuit 32 is suitably formed of a closed loop circuit including an inductor and a capacitor, defining an L-C tank circuit, and an integrated circuit (not shown). The transmitter signal is received at a remote antenna 36 also coupled to the tag circuit 32. The antenna 36 may conveniently be a patch antenna, a coil antenna or any other structure for receiving the transmitter signal.

The tag circuit 32 extracts energy from the transmitter signal received at the antenna 36. The transmitter signal is repeatedly transmitted as pulses at predetermined time intervals, suitably in a broadcast fashion, at a specified rate or in response to an input such as vehicle "KEY ON". The amount of energy received at the tag circuit 32 will vary in accordance with the inverse square law. For example, with the transmitting antenna 24 producing a transmitter signal having a field of about 10 volts per meter, the field strength is approximately 0.3 volts at a distance of about 6 meters. This field received by the remote antenna 36 provides current to the tag circuit 32. Therefore, no physical electrical connection is needed between the transmitter 22 and the tag circuit 32, such that the system 10 may be termed wireless. It will be understood by those skilled in the art that the tag circuit 32 may include a battery or other energy storage device to facilitate operation of the tag circuit 32 at greater distances from the central antenna 24.

The tag circuit 32 is operatively coupled to the switch 28 for detecting the state A or B of the switch 28. In response to the transmitter signal, the tag circuit 32 provides a tag signal according the state of the switch 28 through the antenna 36. In the schematic view of FIG. 1, the oscillation frequency of the tag circuit 32 is modified according to the state, A or B, of the switch 28. In state A, the switch 28 places an inductor 29 into the tag circuit 32, which shifts the frequency of the tag circuit according to its inductance. While the inductor 29 is shown in FIG. 1 to be selectively coupled to the tag circuit 32, it will be understood that other circuit components, integrated circuits or combinations of circuit components and integrated circuits that are responsive to the state of the switch may be used with equal facility. In addition, the tag circuit 32 itself may include appropriate means for sensing the change in the state of the switch 28. Preferably, the tag circuit 32 responds to the transmitter signal regardless of the state of the switch 28, with energization of the tag circuit 32 being independent of the state of the switch 28.

The tag signal transmission from the tag circuit 32 preferably is carried out by way of an electromagnetic radio wave of a substantially constant and predetermined frequency. The transmission is modulated in a known manner to convey the switch status information from the remote tag circuit 32 to the central receiver 26 at the central station 12.

Suitable methods of modulation include frequency shift keying (FSK), differential phase shift keying (DPSK), amplitude shift keying (ASK) as well as any other known modulation scheme. The tag signal may, for example, comprise a unique code associated with the state of the switch 28. Alternatively, the tag signal may comprise a predetermined frequency associated with the state of the switch 28. The tag circuit 32 thus acts through the antenna 36 as both a transmitter for transmitting the tag signal and as a receiver for receiving the transmitter signal.

The tag signal transmitted through the antenna 36 is received at the central antenna 24 and appropriately demodulated at the central receiver 26. The demodulated tag signal is passed to the ECU 18 where it is appropriately decoded and the state of the switch 28 is determined. Where the system includes more than one tag circuit and switch, the tag signal should also contain information to identify each such switch as well as its state. The information concerning the state of the switch 28 may then be used by other systems or components in a conventional manner.

Figure 2:
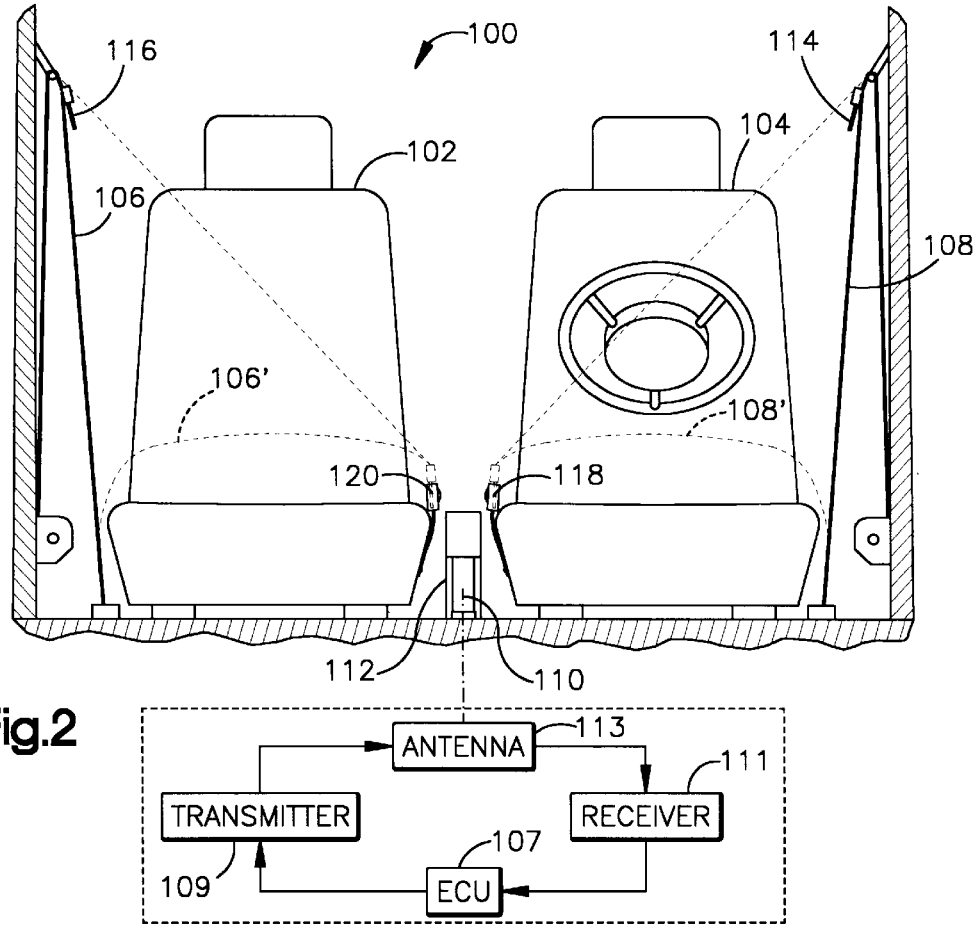
FIG. 2 is a schematic view of the present invention applied to a vehicle seat belt system.

FIG. 2 illustrates a preferred embodiment of the switch detection system of the present invention, generally indicated as 100. More particularly, the system 100 is a portion of a vehicle occupant compartment having a pair of seats 102 and 104, each of which includes a respective retractable seat belt 106 and 108. The seat belts 106 and 108 are illustrated in the unbuckled position, with the buckled positions being illustrated in phantom as 106' and 108'. The switch detection system 100 includes a central station 110, which is substantially identical to that shown and described with respect to FIG. 1. The central station is 110 positioned within the central tunnel 112 of the vehicle between the seats 102 and 104. The central station 110 could be located at any position, such as overhead or in the instrument panel, provided that a sufficient field strength can be supplied to energize the respective tag circuits of the system 100.

The central station 110 includes an ECU 107 and a central transmitter 109 coupled to the ECU 107. A central receiver 111 also is coupled to the ECU 107. The central transmitter 109 and the central receiver 111, which may be an integrated transceiver, are coupled to a central antenna 113 for respectively transmitting and receiving signals. The antenna circuit could include a vehicle radio antenna outside the vehicle or a glass integrated antenna, such as a transparent patch antenna. In addition to the switch detection system 100, the ECU 107 also may control other systems, such as a vehicle occupant protection system, an instrumentation panel or other known systems. The ECU 107 also could be integrated as part of a vehicle keyless entry system or a subset of such system.

Figure 3:
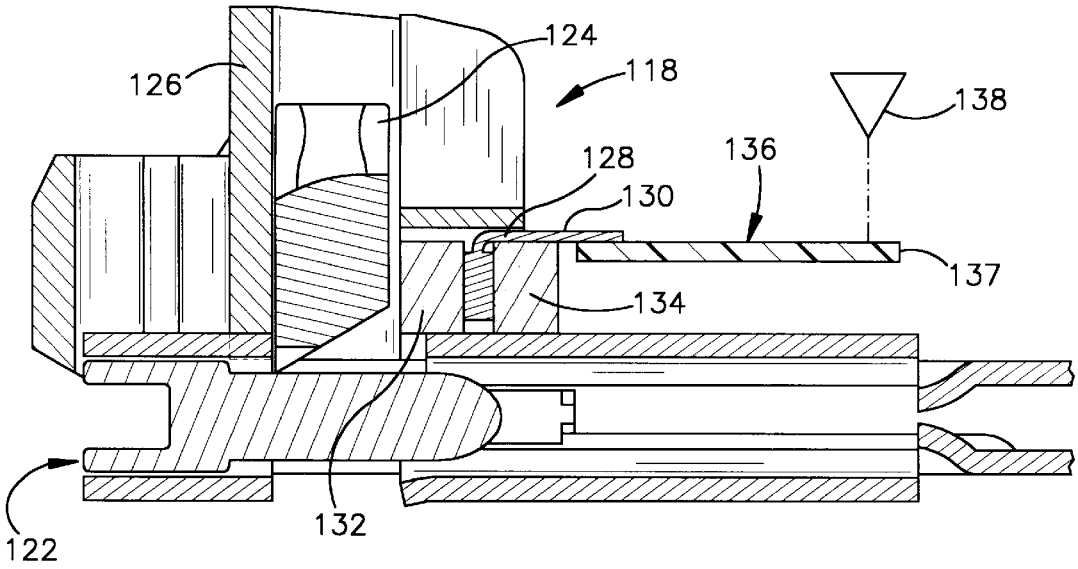
FIG. 3 is a sectional view of a portion of the system of FIG. 2.
Figure 4:
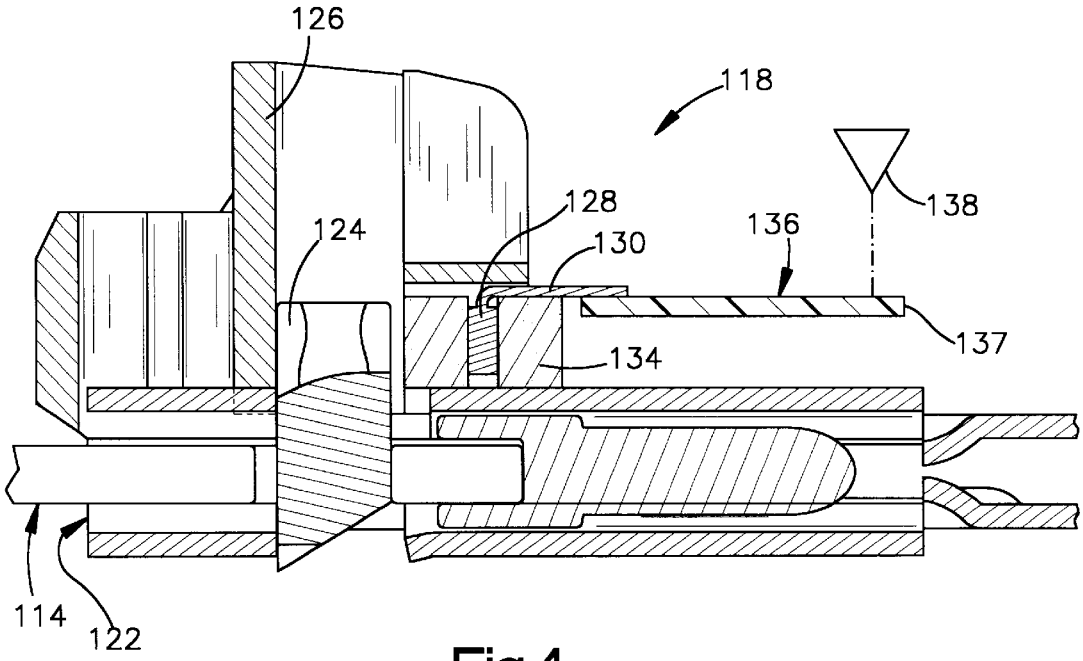
FIG. 4 is a sectional view similar to FIG. 3, illustrating an alternative condition.

The seat belts 106 and 108 each include a buckle tongue 114 and 116 which is received in a corresponding seat belt buckle 118 and 120 located at the respective lower seat portions. An enlarged sectional view of a preferred embodiment of the seat belt buckle 118 is illustrated in FIGS. 3 and 4. The seat belt buckle 118 includes an opening 122 for receiving a buckle tongue 114 (shown in FIG. 4). The buckle 118 also includes a reciprocating latch 124 positioned within a latch guide 126 for longitudinal movement within the latch guide 126.

A switch mechanism 128 is positioned adjacent to the latch 124. The switch mechanism 128 may be any device capable of detecting movement of the buckle latch 124 or whether the seat belt buckle tongue 114 is received appropriately with the buckle 118. For example, the switch mechanism 128 may include a field effect-device, such as a Hall effect device, a reed sensor or a photoelectric sensor. A mechanical switch, or any other known detection mechanism also may be used. The switch mechanism 128 detects a buckled or unbuckled condition.

As shown in the preferred embodiment of FIGS. 3 and 4, the switch mechanism 128 includes a Hall effect device 130 positioned between a pair of permanent magnets 132 and 134. The Hall effect device 130 detects a change in the magnetic field between the magnets 132 and 134 as the latch mechanism 124 moves within the latch guide 126 from a position indicative of an unbuckled condition, as shown in FIG. 3, to a position indicative of a buckled condition, as shown in FIG. 4. The Hall effect device 130 is operatively coupled to a tag circuit 136, which is similar to that shown and described with respect to FIG. 1. The Hall effect device 130 provides a different output to the tag circuit 136, depending on the buckle condition. For example, the Hall effect device provides a first output for a buckled condition and a second, different output for an unbuckled condition. The tag circuit 136 includes an antenna, schematically illustrated as 138, for receiving the central transmitter signal and for transmitting a tag signal indicative of the switch state, which corresponds to the output of the Hall effect device 30. The tag circuit 136 may be on a printed circuit board 137, with the antenna 138 being a patch or coil antenna of known configuration.

As the tag circuit antenna 138 receives the transmitter signal, which is preferably broadcast at predetermined time intervals at a frequency of about 120 kHz, the tag circuit 136 is energized and transmits a tag signal according the state of the buckle switch 128. That is to say, the tag signal indicates whether the latch 124 is received within the aperture of the buckle tongue 114 indicating a buckled condition, as shown in FIG. 4, or whether an unbuckled condition exists, as shown in FIG. 3.

The system 100 might also be configured such that the central transmitter 109 cycles at a higher rate for a predetermined period after the vehicle ignition key is activated and at a lower rate a predetermined time thereafter. The central station 110 also may require that a change of state be verified by a series of continuous detections at the new state. This may be accomplished by the ECU 107 increasing the transmission rate between transmitter signals for a predetermined time period or a predetermined number of pulsed transmitter signals. In response to each transmitter signal, a tag signal should be transmitted by the tag circuit 136. The central receiver 111 receives the tag signals, which are decoded by the ECU 107. Accordingly, the system 100 has means to ignore spurious signals as well as detect a potential fault in the system 100. The information concerning the state of the seat belt switch 128 may be used by one or more other vehicle systems, such as a vehicle occupant protection system or a system to control an indicator light on a vehicle instrument panel.

It will be apparent to those skilled in the art that a circuit in accordance with the present invention may be used to detect the condition of any switch device. In a vehicle, for example, it may be used in connection with a door switch, a trunk switch, a head lamp switch, etc. The present invention also may be used in connection with another vehicle subsystem, such as, for example, a keyless vehicle entry system or other systems where a device having a transmitter and receiver is monitored and/or controlled. In a broader sense, the present invention can be used to detect the condition of any remote switch device.

While the foregoing describes particularly preferred embodiments of the present invention, it is to be understood that the description and the illustrations are indicative only of the principles of the invention and are not to be considered to limit the invention. Because numerous variations and modifications of the invention, all within the scope of the invention, will readily occur to those skilled in the art, the scope of the invention is to be defined by the appended claims.

Having described the invention, the following is claimed:

1. A wireless switch detection system for a vehicle comprising:

a central transmitter for transmitting a transmitter signal;

a remote vehicle switch for mounting in a vehicle at a location spaced apart from said central transmitter, said remote switch having at least two states indicative of a vehicle condition; and a tag circuit separated from said central transmitter, said tag circuit being responsive to and powered by said transmitter signal, said tag circuit detecting the state of said remote vehicle switch and, in response to said transmitter signal, transmitting a tag signal according to the state of said remote vehicle switch.

2. The system of claim 1 wherein said tag signal comprises a unique code associated with the state of said remote vehicle switch.

3. The system of claim 1 wherein said tag signal comprises a predetermined frequency associated with the state of said remote vehicle switch.

4. The system of claim 1 wherein said tag circuit is operatively coupled to said remote vehicle switch.

5. The system of claim 1 further comprising:

a plurality of remote vehicle switches, each having at least two states; and a plurality of tag circuits responsive to and powered by said transmitter signal, each of said tag circuits detecting the state of at least a respective one of said remote vehicle switches and transmitting a tag signal according to the detected state of said respective one of said remote vehicle switches.

6. The system of claim 5 wherein each of said tag signals is unique.

7. The system of claim 6 further comprising:

a central antenna coupled to said central transmitter; and a central receiver coupled to said central antenna for receiving each of said unique tag signals.

8. The system of claim 5 wherein each of said tag signals further comprises unique information identifying a corresponding one of said remote vehicle switches.

9. The system of claim 1 further comprising a central antenna coupled to said central transmitter.

10. The system of claim 9 further comprising a central receiver coupled to said central antenna for receiving said tag signal.

11. The system of claim 1 wherein said tag signal further comprises a unique code indicative of the state of said remote vehicle switch and indicative of information identifying said remote vehicle switch.

12. A seat belt system comprising:

a central transmitter for transmitting a transmitter signal;

a seat belt having a buckle tongue;

a buckle for receiving said buckle tongue, a buckle switch separate from said central transmitter, said buckle switch having two states indicative of whether said buckle tongue is received within said buckle;

a tag circuit responsive to and powered by said transmitter signal, said tag circuit detecting the state of said buckle switch and, in response to said transmitter signal, transmitting a tag signal according to the state of said buckle switch.

13. The seat belt system of claim 12 wherein said tag circuit is operatively coupled to said buckle switch.

14. The seat belt system of claim 12 wherein said central transmitter repeatedly transmits said transmitter signal at predetermined time intervals.

15. The seat belt system of claim 12 wherein said tag signal comprises a unique code associated with the state of said buckle switch.

16. The seat belt system of claim 12 wherein said tag signal has a predetermined frequency associated with the state of said buckle switch.

17. The seat belt system of claim 12 wherein said buckle switch comprises a field effect device having a first output associated with one of the states of said buckle switch and a second output associated with the other state of said buckle switch, said tag signal corresponding to the output of said field effect device.

18. The system of claim 12 further comprising a central antenna coupled to said central transmitter.

19. The system of claim 18 further comprising a central receiver coupled to said central antenna for receiving said tag signal.

20. A wireless switch detection system comprising:

a central transmitter for transmitting a transmitter signal;

a remote switch device spaced apart from said central transmitter, said remote switch device having at least two states and comprising a field effect device;

a tag circuit responsive to and powered by said transmitter signal, said tag circuit detecting the state of said remote switch device and, in response to said transmitter signal, transmitting a tag signal according to the state of said switch, said remote switch device providing an output to said tag circuit indicative of the state of said remote switch device; and a central receiver for receiving said tag signal.

21. A wireless switch detection system comprising:

a central transmitter for transmitting a transmitter signal;

a remote switch device spaced apart from said central transmitter, said remote switch device having at least two states and comprising a buckle for receiving a buckle tongue and;

a tag circuit responsive to and powered by said transmitter signal, said tag circuit detecting the state of said remote switch device and, in response to said transmitter signal, transmitting a tag signal according to the state of said switch; and a central receiver for receiving said tag signal.

22. The system of claim 21 wherein said tag signal is indicative of whether said buckle tongue is received within said buckle.

* * * * *